US012680301B2

(12) United States Patent
Nielsen et al.

(10) Patent No.: US 12,680,301 B2
(45) Date of Patent: Jul. 14, 2026

(54) EXTERIOR BUILDING AUGMENTATION SYSTEM

(71) Applicant: Cover Technologies, Inc., Gardena, CA (US)

(72) Inventors: Gregory Nielsen, Gardena, CA (US); Anthony Karroum, Gardena, CA (US); Katya Stavisky, Gardena, CA (US); Hamahito Hokyo, Gardena, CA (US); Craig Derian, Gardena, CA (US); Jemuel Joseph, Gardena, CA (US); Alexis Xaiver Rivas, Gardena, CA (US)

(73) Assignee: Cover Technologies, Inc., Gardena, CA (US)

( * ) Notice: Subject to any disclaimer, the term of this patent is extended or adjusted under 35 U.S.C. 154(b) by 101 days.

(21) Appl. No.: 18/433,312

(22) Filed: Feb. 5, 2024

(65) Prior Publication Data

US 2024/0263447 A1 Aug. 8, 2024

Related U.S. Application Data

(60) Provisional application No. 63/443,247, filed on Feb. 3, 2023, provisional application No. 63/443,240, filed (Continued)

(51) Int. Cl.
*E04F 19/00* (2006.01)
*E04B 2/00* (2006.01)

(Continued)

(52) U.S. Cl.
CPC ..... *E04C 2/284* (2013.01); *E04C 2/384* (2013.01); *E04C 2/46* (2013.01); *E04C 2/526* (2013.01)

(58) Field of Classification Search
CPC ..... E04C 2/384; E04C 2/526; E04B 2/90
See application file for complete search history.

(56) References Cited

U.S. PATENT DOCUMENTS 2,414,060 A * 1/1947 Rausch ..... E04B 1/6141 403/219
3,367,076 A * 2/1968 O'Brien ..... E04C 2/296 52/592.4

(Continued)

*Primary Examiner* — Basil S Katcheves
(74) *Attorney, Agent, or Firm* — Run8 Patent Group, LLC; Peter Miller; Marissa Kohrman

(57) ABSTRACT

A building system includes: an exterior mount; a wall panel; and an exterior attachment. The wall panel includes: a left column element carrying vertical loads through a left side of the wall panel abutting a right column element of an adjacent wall panel; an exterior surface extending across the left column element and cooperating with a second exterior surface of the adjacent wall panel to form an exterior façade; and a left channel section coupled to the left column element, recessed behind the exterior surface, cooperating with a right channel section of the adjacent wall panel to define an exterior mounting receptacle, facing outwardly from the wall panel, extending vertically between the wall panel and the adjacent wall panel, recessed behind the exterior façade, and configured to transiently retain the exterior mount. The exterior attachment: transiently installs on the exterior mount; and extends from the exterior façade.

20 Claims, 5 Drawing Sheets

Related U.S. Application Data on Feb. 3, 2023, provisional application No. 63/443,251, filed on Feb. 3, 2023.

(51) Int. Cl.

| | |
|---|---|
| ***E04C 2/284*** | (2006.01) |
| ***E04C 2/38*** | (2006.01) |
| ***E04C 2/52*** | (2006.01) |

(56) References Cited

U.S. PATENT DOCUMENTS

| | | | | | |
|---|---|---|---|---|---|
| 4,905,428 | A * | 3/1990 | Sykes | E04B 2/745 | 52/270 |
| 5,125,201 | A * | 6/1992 | Pieters | E04B 2/7455 | 52/468 |
| 5,305,567 | A * | 4/1994 | Wittler | F16B 5/0056 | 52/586.1 |
| 5,411,782 | A * | 5/1995 | Jarvis | E04H 4/08 | 428/188 |
| 5,787,642 | A * | 8/1998 | Coyle | E06B 9/01 | 52/202 |
| 6,036,398 | A * | 3/2000 | Theodorou | E04F 11/181 | 403/302 |
| 6,085,485 | A * | 7/2000 | Murdock | E04C 2/36 | 52/794.1 |
| 6,493,995 | B2 * | 12/2002 | Mckenzie | A47F 5/105 | 52/239 |
| 9,312,411 | B2 * | 4/2016 | Laurin | H10F 19/00 | |
| 9,617,731 | B2 * | 4/2017 | Baxter | E04B 2/7405 | |
| 9,848,741 | B2 * | 12/2017 | Slothower | A47K 3/283 | |
| 9,988,820 | B2 * | 6/2018 | Komatsu | E04B 9/24 | |
| 10,041,249 | B1 * | 8/2018 | Hebert | E04G 21/243 | |
| 10,501,933 | B2 * | 12/2019 | Stroyer | E04B 2/7836 | |
| 10,595,442 | B2 * | 3/2020 | Davis | A47B 47/0041 | |
| 10,738,470 | B2 * | 8/2020 | Kreizinger | E04D 3/351 | |
| 2002/0020120 | A1 * | 2/2002 | McKenzie | A47F 5/105 | 52/793.11 |
| 2003/0208973 | A1 * | 11/2003 | Corden | E04B 2/7453 | 52/241 |
| 2007/0044416 | A1 * | 3/2007 | Van Dijk | E04F 13/18 | 52/650.3 |
| 2007/0251183 | A1 * | 11/2007 | Thiagarajan | E04C 2/543 | 52/590.1 |
| 2010/0229484 | A1 * | 9/2010 | Carolan | E04B 2/90 | 52/302.1 |
| 2011/0047908 | A1 * | 3/2011 | Brusman | E04C 2/22 | 52/800.1 |
| 2012/0216476 | A1 * | 8/2012 | Naidoo | E04C 2/20 | 52/794.1 |
| 2015/0300017 | A1 * | 10/2015 | Carolan | E04F 13/0803 | 52/483.1 |
| 2022/0186449 | A1 * | 6/2022 | Cail | E04C 2/24 | |
| 2023/0160215 | A1 * | 5/2023 | Orjebin | B32B 3/06 | 52/483.1 |

* cited by examiner

EXTERIOR BUILDING AUGMENTATION SYSTEM

CROSS-REFERENCE TO RELATED APPLICATIONS

This Application claims priority to U.S. Provisional Patent Application Nos. 63/443,251, filed on 3 Feb. 2023, 63/443,247, filed on 3 Feb. 2023, and 63/443,240, filed on 3 Feb. 2023, each of which is incorporated in its entirety by this reference.

TECHNICAL FIELD

This invention relates generally to the field of prefabricated structural system and more specifically to a new and useful exterior building augmentation system in the field of prefabricated structural system.

DESCRIPTION OF THE EMBODIMENTS

Figure 1:
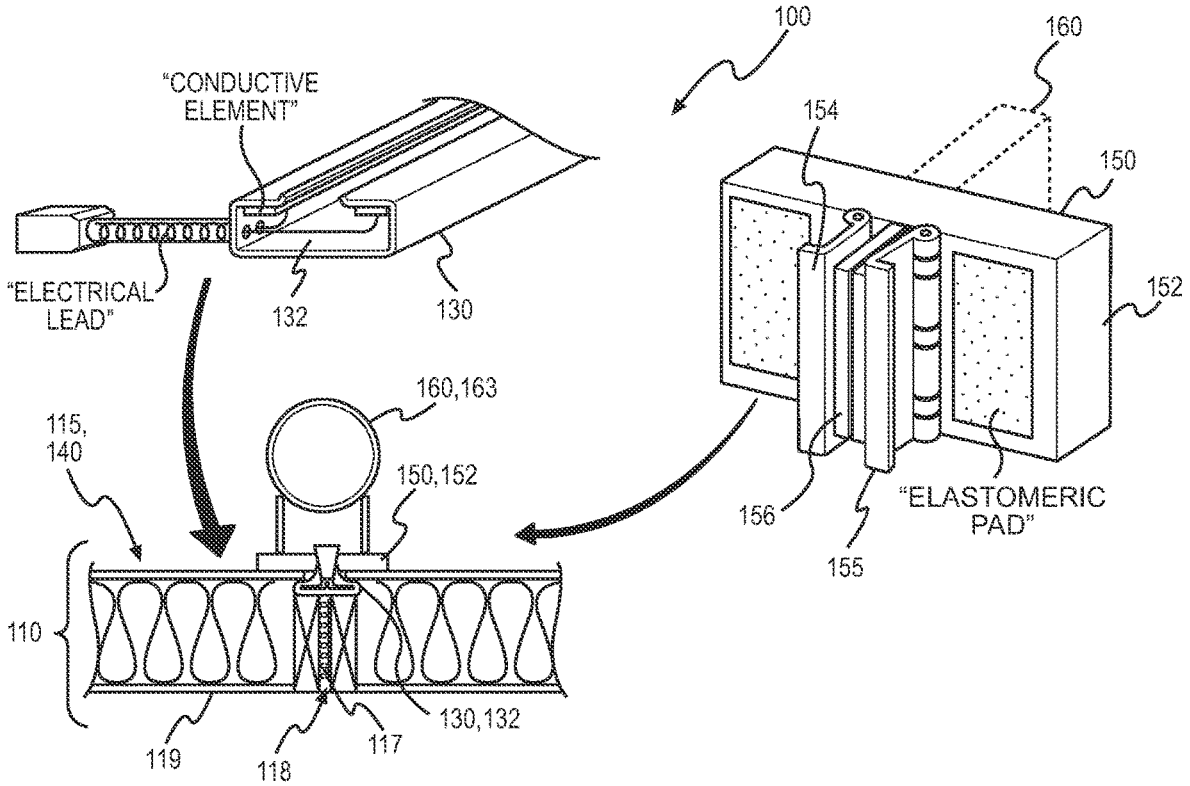
FIG. 1 is a flowchart representation of a system.

The following description of embodiments of the invention is not intended to limit the invention to these embodiments but rather to enable a person skilled in the art to make and use this invention. Variations, configurations, implementations, example implementations, and examples described herein are optional and are not exclusive to the variations, configurations, implementations, example implementations, and examples they describe. The invention described herein can include any and all permutations of these variations, configurations, implementations, example implementations, and examples.

1. Exterior Building Augmentation System

As shown in FIGS. 1, 2, 3, and 4, an exterior building augmentation system 100 includes: a first wall panel 110; and a second wall panel 110.

The first wall panel 110 is configured to install on a floor panel 170 and includes: a first left column element 111 configured to carry vertical loads through a left side of the first wall panel 110; a first right column element 112 configured to carry vertical loads through a right side of the first wall panel 110; a first footer element 113 extending between the first left column element 111 and the first right column element 112 and configured to seat on the floor panel 170; a first header element 114 extending between the first left column element 111 and the first right column element 112 above the first footer element 113; a first exterior surface 115 extending across the first left column element 111 and the first right column element 112; and a first left channel section 116 coupled to the first left column element 111 and recessed behind the first exterior surface 115.

The second wall panel 110 is configured to install on the floor panel 170 adjacent the first wall panel 110 and includes: a second right column element 112 configured to abut the first left column element 111 of the first wall panel 110; and a second exterior surface 115 extending across the second right column element 112 and cooperating with the first exterior surface 115 of the first wall panel 110 to form an exterior façade 140. The second wall panel 110 also includes a second right channel section 117: coupled to the second right column element 112; recessed behind the second exterior surface 115; and cooperating with the first left channel section 116 to define an exterior mounting receptacle a) facing outwardly from the second wall panel 110, b) extending vertically between the first wall panel 110 and the second wall panel 110, c) recessed behind the exterior façade 140, and d) configured to transiently retain an exterior mount 150, the exterior mount 150 locating an exterior attachment 160 over the exterior façade 140.

In one variation, the exterior building augmentation system 100 includes: an exterior mount 150; and a functional exterior attachment 160 configured to transiently install on the exterior mount 150 and extend from the exterior façade 140.

1.2 Mechanical+Electrical Exterior Building Augmentation System

Figure 2:
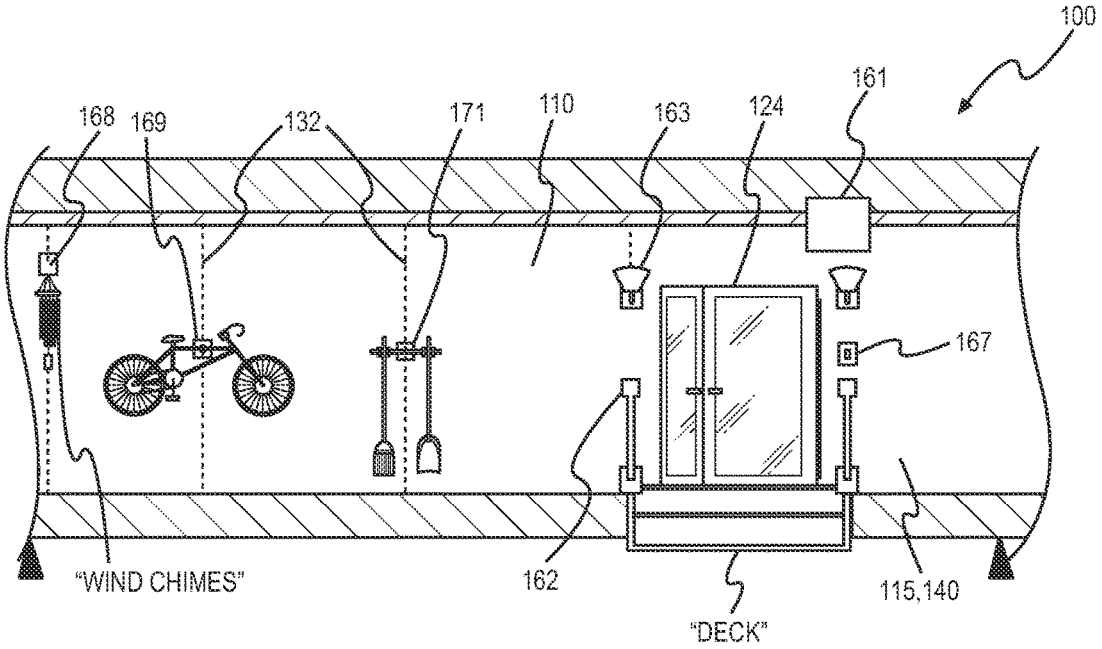
FIG. 2 is an elevation view of one variation of the system.

In another variation shown in FIGS. 1 and 2, an exterior building augmentation system 100 includes: a set of prefabricated wall panels 110 configured to assemble into a wall of a building; a set of channels; a kit of mechanical exterior attachments 160; and/or a kit of electrical exterior attachments 160.

Each wall panel 110 defines: an exterior surface 115 including left and right exterior edges; and a pair of channel sections extending vertically behind the left and right exterior edges.

Each channel: includes a C-section defining an exterior mounting receptacle; is configured to insert into adjacent channel sections of a pair of adjacent wall panels 110 assembled in the wall with the exterior mounting receptacle 132 facing outwardly from a gap located between exterior surfaces 115 of the pair of adjacent wall panels 110; and defines a pair of isolated electrical contacts arranged inside of the C-section and extending along each side of the exterior mounting receptacle 132.

Alternatively, when a pair of wall panels 110 are assembled, abutting channel sections of these two wall panels 110 can cooperate to form the exterior mounting receptacle 132 (i.e., without a separate channel defining the exterior mounting receptacle 132 and inserted between the abutting channel sections).

Each mechanical exterior attachment 160: defines a base; includes a set of retention elements a) extending rearward from the base and b) configured to transiently insert into an exterior mounting receptacle 132, defined between two abutting wall panels 110, and seats against interior surfaces of the exterior mounting receptacle 132 to retain the base 152 against exterior surfaces 115 of this pair of wall; and includes a mechanical element (e.g., a banister 162, a fenestration 124 awning, a rainscreen panel) mounted to the base 152 opposite the set of retention elements.

Each electrical exterior attachment 160: defines a base 152; includes a set of retention elements a) extending rearward from the base 152 and b) configured to transiently insert into an exterior mounting receptacle 132, defined between two abutting wall panels 110, and seats against the isolated electrical contacts to retain the base 152 against exterior surface 115 of this pair of adjacent wall panels 110; and includes an electrical element mounted to the base 152 opposite the set of retention elements, electrically coupled to the set of retention elements, and configured to source electrical current from the building via the retention elements and the exterior mounting receptacle 132.

2. Applications

Generally, the exterior building augmentation system 100 includes: a set of wall panels 110 configured to assemble into an exterior wall of a building; and a set of channels configured to assemble between adjacent wall panels 110 to form attachments and to cover vertical junctions between these wall panels 110. The exterior building augmentation system 100 further includes a set of attachments configured to transiently install on the channel 130 and thus augment the building with: exterior lighting; exterior mechanical systems (e.g., hose bibs); exterior tool and material storage; exterior building-hung staircases; etc.

In particular, a channel 130 can be installed between vertical sides of two adjacent wall panels 110 of the building in order to: form a finished surface over the junction between these wall panels 110; and form a mechanical structure for non-destructive, adjustable, and transient installation of attachments on the building.

A channel 130 can further include isolated electrical contacts extending along each side of its exterior mounting receptacle and connected to a main electrical panel in the building. Accordingly, an attachment including an electrical element (e.g., lighting, a solar panel 161, a wireless doorbell 167) can install on the channel 130 and source or sink power from or to the main electrical panel in the building via the channel 130.

Figure 3:
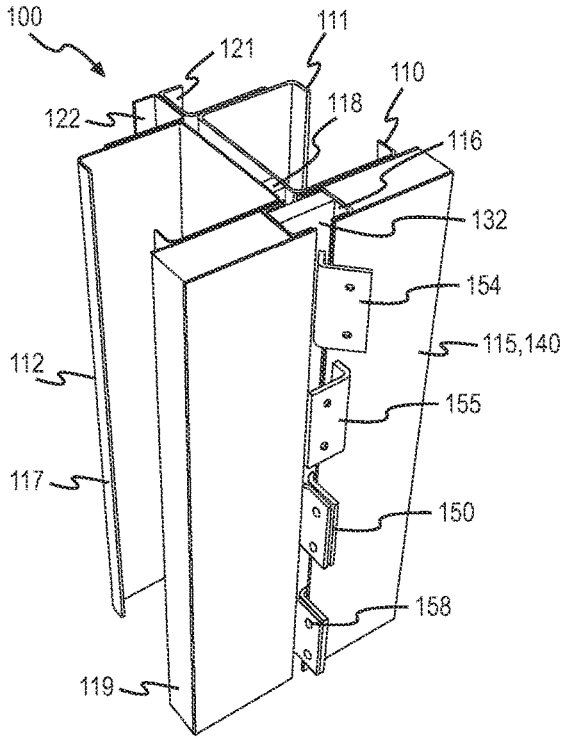
FIG. 3 is a schematic representation of one variation of the system.
Figure 4:
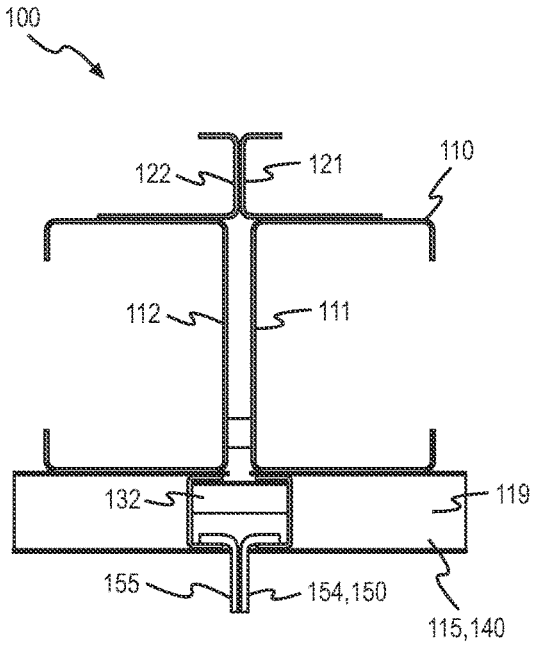
FIG. 4 is a schematic representation of one variation of the system.
Figure 5:
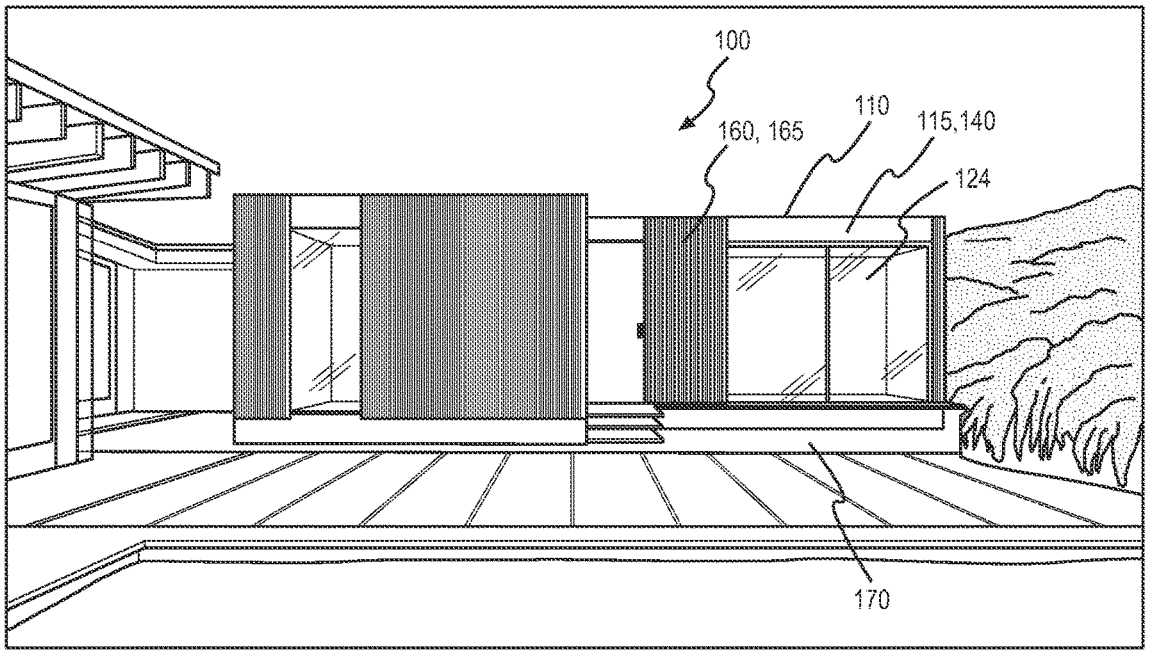
FIG. 5 is an elevation view of one variation of the system.

Alternatively, as shown in FIGS. 3 and 4, each wall panel 110 in the exterior building augmentation system 100 can define a channel section extending vertically along its left and right sides and inset from its exterior surface 115. Accordingly, the abutting left and right channel sections 116, 117 of two adjacent wall panels 110 can cooperate to form an exterior mounting receptacle—in place of a discreet channel—along the junction between these two wall panels 110. The exterior mounting receptacle 132 can thus support a suite of exterior mounts 150 and functional exterior attachments 160, such as: a light element 163; a solar panel 161; a universal mount 168; a bin; a tool or bicycle rack 169; a railing or banister 162; a window or door (i.e., "fenestration 124") awning; a secondary exterior rainscreen façade panel; a secondary exterior aesthetic panel; or a secondary exterior insulation augmentation panel, as shown in FIGS. 2 and 5.

Therefore, the exterior building augmentation system 100 defines a complete exterior wall assembly and building accessory attachments that enable a user (e.g., a homeowner) to install, move, and uninstall various mechanical and electrical exterior attachments 160 on the building over time in order to accommodate various and changing exterior needs at the building over time.

2.1 Examples

For example, the exterior building augmentation system 100 can include mechanical exterior attachment 160, such as: a stair attachment; a hose bib attachment; and/or a generic or "universal" attachment onto which a user may fasten custom or personal elements.

In another example, the exterior building augmentation system 100 can include electrical exterior attachments 160, such as: a lighting attachment; a speaker attachment; a television attachment; an electrical outlet attachment; and/or a fan attachment. In this example, the system can also include a solar panel 161 attachment, such as: for supplying electrical current to an electrically-isolated channel, which then functions as an electrical bus for distributing electrical power to other electrical attachments installed on the same channel; or for supplying power to a building electrical main (e.g., as via an inverter).

In another example, the exterior building augmentation system 100 can include an entertainment exterior attachment 160, such as: a grill or cooking burner attachment (e.g., paired with a second attachment including a tray or shelf configured to support a fuel tank); a table attachment; a shelf attachment; and/or an ice machine attachment.

In another example, the exterior building augmentation system 100 can include maintenance exterior attachments 160, such as: a shovel, rake, or other tool-hanging attachment; a waste (e.g., trash, recycling, composting) bin attachment; and/or a composting drum attachment.

In another example, the exterior building augmentation system 100 can include storage exterior attachments 160, such as: a container attachment; a cabinet attachment; and/or a bicycle storage attachment.

3. Wall Panel

Generally, a wall panel 110 defines a structural element configured: to install on one or an array of floor panels 170; to form a segment of a structural wall; to cooperate with additional wall panels 110 to form the complete structural wall; and to support one or an array of roof panels. A wall panel 110 can include: vertical column elements connected by header and footer elements 114, 113; insulation 119 or a fenestration 124 between these column elements; an exterior panel defining a prefinished exterior surface 115; and interior elements configured to receive and locate interior façade panels.

Figure 7:
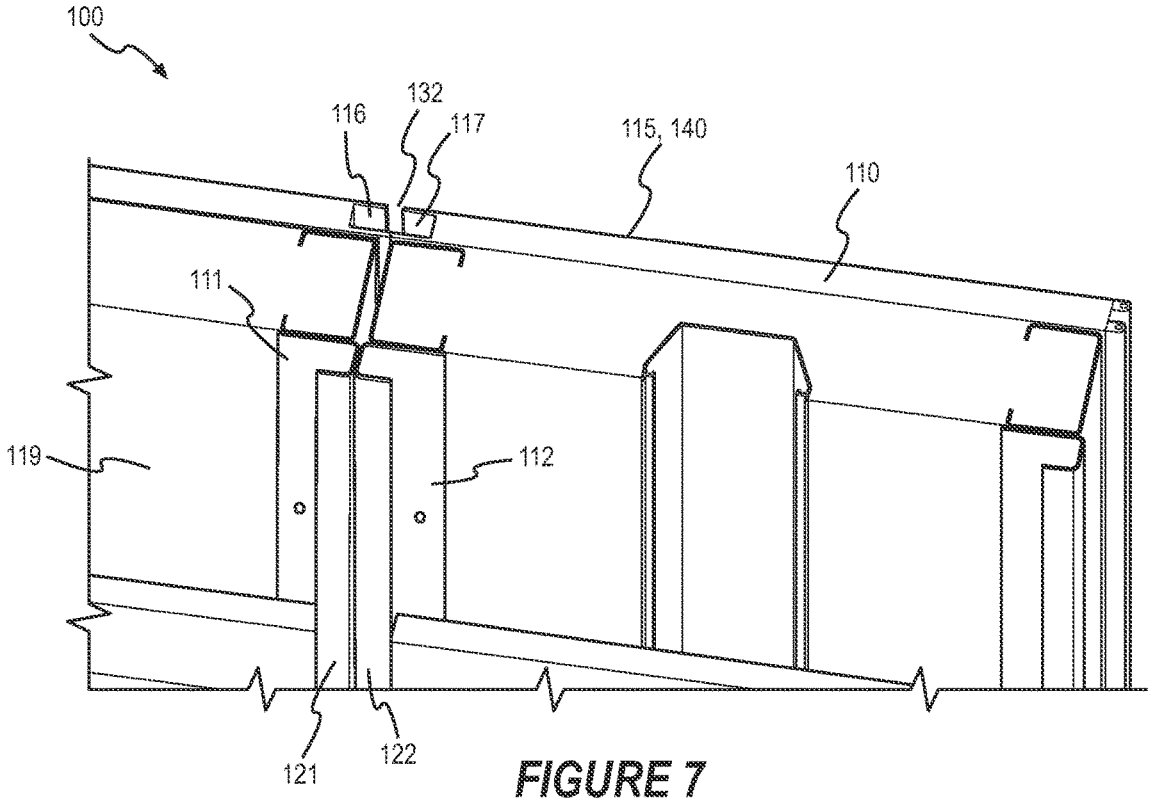
FIG. 7 is a schematic representation of one variation of the system.
Figure 8:
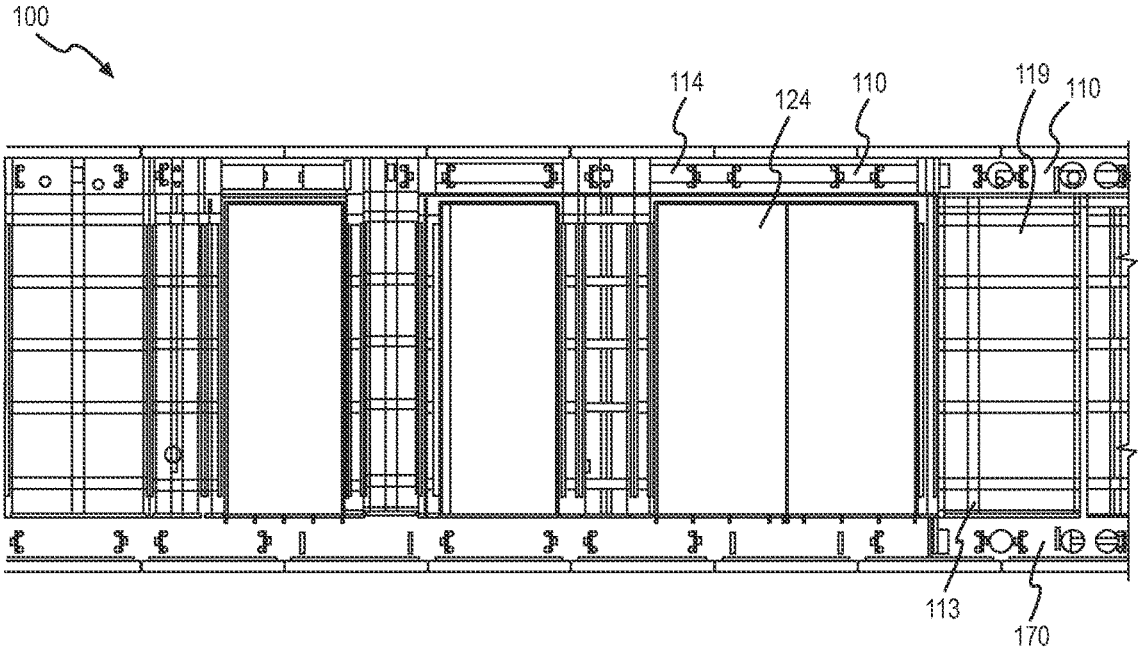
FIG. 8 is an elevation view of one variation of the system.

In one implementation shown in FIGS. 7 and 8, a wall panel 110 is configured to install on a floor panel 170 and includes: a left column element 111 configured to carry vertical loads through a left side of the wall panel 110; and a right column element 112 configured to carry vertical loads through a right side of the wall panel 110. In this implementation, the wall panel 110 also includes: a footer element 113 extending between the left column element 111 and the right column element 112 and configured to seat on the floor panel 170; a header element 114 extending between the left column element 111 and the right column element 112 above the footer element 113; and an exterior surface 115 extending across the left column element 111 and the right column element 112.

In this implementation, the exterior building augmentation system 100 can include additional similar wall panels 110 that fasten to a floor panel 170 and fasten together in series to from a complete structural wall. For example, the left and right column elements 111, 112 of each wall panel 110 can include a series of through-bores, and threaded fasteners can be inserted through through-bores in two adjacent wall panels 110 to fasten these wall panels 110 together. These wall panels 110 can be similarly bolted or strapped to the floor panel(s) 170.

In another example described below, each wall panel 110 can include a clinch flange extending rearward from each of the left and right column elements 111, 112 of the wall panel 110. A clinch tool can then be run along abutting clinch flanges of two adjacent wall panels 110 to locate a series of clinch connection along these flanges and thus fasten these two wall panels 110 together.

4. Discrete Inter-Panel Vertical Channel

Generally, a channel 130 is configured to install vertically between a vertical junction between two adjacent prefabricated wall panels 110 of a building.

In one implementation shown in FIG. 1, a channel 130 defines a unitary structure defining a cross-section approximating a C-channel. For example, the channel 130 can include: a base segment at the rear of the C-channel; left and right legs extending forward from the base segment to define the depth of the channel 130 sufficient to accept a retention element (or "prong") of an attachment); and left and right returns extending toward the longitudinal centerline of the channel 130 to define an exterior mounting receptacle sufficient to accept the retention element of the exterior mount 150.

Accordingly, each wall panel 110 can define a channel section (or "groove") extending along each vertical edges of the wall panel 110 and adjacent and inset from the exterior surface 115 of the wall panel 110. In particular, the wall panel 110 can include: a left channel section 116 on a left edge of the wall panel 110 approximating an external geometry of a right half of a channel 130; and a similar right channel section 117 on a right edge of the wall panel 110 approximating an external geometry of a left half of the channel 130. In one implementation, the left and right channel sections 116, 117 terminate above a bottom of the wall panel 110. Alternatively, the wall panel 110 can include a set of stops extending into these channel sections to prevent the channel 130 from sliding downwardly along the wall panel 110 when loaded with an exterior mount 150.

Therefore, during assembly of two wall panels 110, an installer may: insert the channel 130 into the adjacent and opposing channel sections of the two abutting wall panels 110; and then laterally fasten the wall panels 110 together, such as by installing a column of clinch connections along abutting vertical flanges on these wall panel 110 or by installing and tightening threaded fasteners through abutting corners of these wall panels 110. By fastening the wall panels 110 together, the installer thereby: closes a vertical gap between the wall panels 110; closes the abutting channel sections of the two wall panels 110 around the channel 130; and compresses the channel 130 between these wall panels 110 to rigidly locate and retain the channel 130. Furthermore, the channel 130 thus covers a vertical gap or interface along a sagittal plane between the two abutting wall panels 110 to create a finished exterior seam between these wall panels 110.

More specifically, when assembled, the adjacent vertical edges of the wall panels 110 are offset by approximately the width of the exterior mounting receptacle 132 of the channel 130. The channel 130—seated in the adjacent channel sections of these two wall panels 110—thus: supports the adjacent vertical edges of these wall panels 110; forms a finished surface behind the gap between the adjacent vertical edges of these wall panels 110; and covers the sides of these wall panels 110 (i.e., parallel to a sagittal plane of the wall panels 110) that may otherwise be visible through the gap between the exterior surfaces 115 of these wall panels 110.

4.1 Electrified Discrete Channel Structure

In one variation shown in FIG. 1, the discrete channel can be formed of a non-conductive material (e.g., nylon, carbon fiber). The channel 130 can further include a pair of conductive elements arranged inside of and extending along the length of the channel 130, including: a first conductive element arranged on a first side of the longitudinal centerline of the channel 130; and a second conductive element arranged on a second, opposite side of the longitudinal centerline of the channel 130. Furthermore, in this variation, the channel 130 can include a set of electrical leads, including: a first electrical lead extending from the first conductive element and configured to connect to an electrical main in the building (e.g., via a DC converter); and a second electrical lead extending from the second conductive element and configured to connect to the electrical main.

In particular, the first conductive element can be arranged along the interior of the channel 130 adjacent and to the left of the exterior mounting receptacle 132; and the second conductive element can be arranged along the interior of the channel 130 adjacent and to the right of the exterior mounting receptacle 132. When an exterior mount 150 is located in the channel 130 and tightened against the channel 130 and/or the faces of the adjacent wall panels 110, retention elements of the exterior mount 150 compress against interior surfaces of the channel 130 immediately to the left and right of the exterior mounting receptacle 132. Because the conductive elements are arranged on each side of the exterior mounting receptacle 132, these retention elements are thus compressed against the conductive elements in the channel 130, thereby yielding robust and isolated electrical connectivity between the retention elements of the exterior mount 150 and these conductive elements.

For example, the first and second conductive elements can include solid copper or aluminum ribbons, each: soldered to an electrical lead extending from the channel 130; and overmolded or co-extruded in a polymer (e.g., nylon) to form the channel 130 with exposed surfaces of the conductive elements facing the interior of the channel 130 and arranged on each side of the exterior mounting receptacle 132.

In another example, the channel 130 is formed of a rigid metallic material, such as extruded aluminum, and the interior of the channel 130 is coated with a non-conductive (e.g., silicone rubber) coating. In this example, the first conductive element includes a first PCB strip with a conductive trace extending along a single side of the first PCB strip and soldered to a first electrical lead. Accordingly, the first PCB strip is arranged in the channel 130 and is bonded to the interior of the channel 130 adjacent and to the left of the exterior mounting receptacle 132. The second conductive element similarly includes a second PCB strip with a conductive trace extending along a single side of the second PCB strip and soldered to a second electrical lead. The second PCB strip is similarly arranged in the channel 130 and is bonded to the interior of the channel 130 adjacent and to the right of the exterior mounting receptacle 132.

Furthermore, the electrical leads can extend from a top of the channel 130 for connection to electrical service or an electrical wiring harness arranged behind a ceiling panel in the building. Alternatively, the electrical leads can extend from a bottom of the channel 130 for connection to electrical service or an electrical wiring harness arranged below the wall panels 110, such as located along or behind a rim joist below the wall panels 110. Yet alternatively, the electrical leads can be configured to connect directly into a wiring harness integrated into the one of the two wall panels 110 installed around the channel 130.

Therefore, in this variation, an installer may: assemble two wall panels 110 and the channel 130 as described above; and connect the electrical leads—extending from the channel 130—to electrical service or to a wiring harness within an adjacent structure (e.g., a roof, wall, or floor panel 170).

5. Integral Exterior Mounting Receptacle

In one variation shown in FIGS. 3 and 4, each wall panel 110 in the exterior building augmentation system 100 can define a channel section extending vertically along its left and right sides and inset from its exterior surface 115. Accordingly, the abutting left and right channel sections 116, 117 of two adjacent wall panels 110 can cooperate to form an exterior mounting receptacle—in place of a discreet channel—along the junction between these two wall panels 110.

In this implementation, a first wall panel 110 can include: a first left channel section 116 coupled to the first left column element 111 and recessed behind the first exterior surface 115 of the first wall panel 110; and a first right channel section 117 coupled to the first right column element 112 and recessed behind the first exterior surface 115 of the first wall panel 110. In this variation, a second wall panel 110 can includes a second right channel section 117: coupled to the second right column element 112; recessed behind the second exterior surface 115; and cooperating with the first left channel section 116 to define an exterior mounting receptacle. In this implementation, the exterior mounting receptacle 132 can: face outwardly from the first and second wall panels 110; extend vertically between the first wall panel 110 and the second wall panel 110; can be recessed behind the exterior façade 140; and can be configured to transiently retain an exterior mount 150, which locates an exterior attachment 160 over the exterior façade 140.

In particular, in this variation, rather than a discrete channel installed between channel sections of two wall panels 110 and defining the exterior mounting receptacle 132, these wall panels 110 define channel sections along their vertical sides, and two abutting channel sections—in two assembled, abutting wall panels 110—cooperate directly to form the exterior mounting receptacle 132.

In one implementation, a left channel section 116 is integrated into the left side of a first wall panel 110 (e.g., along and inset from a left vertical edge of the exterior surface 115 of the first wall panel 110); and the right channel section 117 is similarly integrated into the right side of a second wall panel 110 (e.g., along and inset from a right vertical edge of the exterior surface 115 of the second wall panel 110).

For example, a left channel section 116 can include an extruded aluminum or folded steel section forming a "J" profile riveted, (spot-) welded, bonded, or clinched to the left column element 111 of a wall panel 110. A right channel section 117 can similarly include an extruded aluminum or folded steel section forming a "J" profile riveted, (spot-) welded, bonded, or clinched to the right column element 112 of the wall panel 110. Other wall panels 110 in the exterior building augmentation system 100 can include similar left and right channel sections 116, 117.

Thus, when two wall panels 110 are abutted and assembled over a floor panel 170, the left channel section 116 of a first wall panel 110 can cooperate with a right channel section 117 of the adjacent, second wall panel 110 to form an exterior mounting receptacle located between these two wall panels 110 and inset from the (prefinished) exterior surfaces 115 defined by these two wall panels 110. During assembly, a non-conductive (e.g., rubber) gasket 118 can be installed: between the two abutting faces of the left and right sides of these two wall panels 110; behind the exterior mounting receptacle 132; and running vertically along the junction between these two wall panels 110. Assembly of the wall panels 110 can compress the gasket 118 between the abutting faces of these wall panels 110, thereby sealing and enclosing a gap between these wall panels 110.

5.1 Integral Channel Section: Wall Panel Manufacturing

In one implementation, a wall panel 110 is formed by: locating a non-conductive exterior façade 140 panel (e.g., a prefinished polymer film or sheet) face-down in a jig; clamping the left and right channel sections 116, 117—each connected to an electrical lead—to the jig along the left and right edges of the exterior façade 140 panel; assembling a steel perimeter frame (e.g., including a header 114, a footer 113, a left column element 111, and a right column element 112) over the exterior façade 140 panel in the jig; routing the electrical leads to a harness or connector near a perimeter of the steel perimeter frame; and injecting expanding structural foam into voids between the exterior façade 140 panel, the channel sections, and the steel perimeter frame. The expanding structural foam thus: bonds the exterior façade 140 and the left and right channel sections 116, 117 to the steel perimeter frame; electrically isolates the left and right channel sections 116, 117 from the perimeter frame; and fills a volume within the perimeter frame to increase load-carrying and shear capacity of the wall panel 110. Additionally or alternatively, the left and right channel sections 116, 117 can be riveted, fastened, clinched, welded, and/or bonded to the column elements of the perimeter frame.

In this implementation, when an installer later assembles two like wall panels 110, the installer may insert a non-conductive seal and isolator between abutting sides of these wall panels 110, thereby: electrically isolating the left channel section 116 of the first wall panel 110 from the right channel section 117 of the second wall panel 110; and sealing the interface between these wall panels 110 from water ingress.

Alternatively, in this implementation, the wall panel 110 can exclude electrical connections, and each wall panel 110 can include channel sections arranged along its left and right edges and cooperating with similar channel sections of adjacent wall panels 110 to form passive (i.e., non-electrified) channels.

6. Variation: Ribbed Exterior Mounting Receptacle

In one variation, the channel 130 (or abutting channel sections) includes ribbed or serrated internal surfaces that yield greater vertical load holding on retention elements (prongs, cams) of exterior mounts 150 installed in the exterior mounting receptacle 132.

7. Wall Panel Assembly

As described above and shown in FIG. 8, a row of wall panels 110 can be assembled into a load-bearing, structural wall assembly of a building, including an exterior mounting receptacle 132 located at each wall panel 110 junction. For example, each wall panel 110 can define a width of two meters, and a structural wall assembly can thus include a series of exterior mounting receptacles located along the wall assembly on two-meter centers.

7.1 Clinch Connections

In one implementation shown in FIGS. 3, 4, and 7, wall panels 110 are configured to assemble via a series of a clinch connections along abutting clinch flanges extending rearward (i.e., opposite the exterior mounting receptacles 132) from their left and right sides. For example, a first wall panel 110 can further include: a first left clinch flange 121 extending rearward from a first left column element 111, opposite a first exterior surface 115, of the first wall panel 110; and a first left return flange extending laterally from the first left clinch flange 121, opposite a second wall panel 110, to stiffen the first left clinch flange 121. The second wall panel 110 can similarly include a second right clinch flange 122: extending rearward from a second right column element 112, opposite a second exterior surface 115, of the second wall panel 110; and configured to mate to the first left clinch flange 121 of the first wall panel 110 via a series of clinch connections. The second wall panel 110 can similarly include a second right return flange extending laterally from the second right clinch flange 122, opposite the first wall panel 110, to stiffen the second right clinch flange 122.

Thus, a series of clinch connections can be installed through the first left and second right clinch flanges 122: to assemble the second wall panel 110 to the first wall panel 110; and to locate a second right channel section 117 of the second wall panel 110 adjacent a first left channel section 116 of the first wall panel 110 to form an exterior mounting receptacle between these two wall panels 110. Alternatively, a channel 130 defining the exterior mounting receptacle 132 can be inserted between the two wall panels 110 during assembly. A series of clinch connections can then be installed through the first left and second right clinch flanges 122: to assemble the second wall panel 110 to the first wall panel 110; and retain the channel 130 between these two wall panels 110.

Furthermore, in this implementation, the first left clinch flange 121 can be laterally offset from the first left column element 111 toward the second wall panel 110; and the second right clinch flange 122 can be similarly laterally offset from the second right column element 112 toward the first wall panel 110. The second right clinch flange 122 of the second wall panel 110 can thus mate to the first left clinch flange 121 of the first wall panel 110, via the series of clinch connections, to form a seal receptacle (or "gap") between a left face of the first left column element 111 of the first wall panel 110 and a right face of the second right column element 112 of the second wall panel 110. Accordingly, the exterior building augmentation system 100 can include a gasket 118 configured: to insert into this seal receptacle; and to compress against the left face of the first left column element 111 and the right face of the second right column element 112 during assembly of the wall panels 110, thereby sealing the junction between these wall panels 110 from water and/or dust ingress. The second right channel section 117 of the second wall panel 110 can further cooperate with the first left channel section 116 to locate or define the exterior mounting receptacle 132 between the gasket 118 and the exterior façade 140.

7.2 Alternative Wall Panel Connections

Alternatively, as described above, adjacent wall panels 110 can be assembled via bolts or other threshold fasteners, rivets, welds, or adhesive, etc.

8. Variation: Intra-Panel Vertical Exterior Mounting Receptacle

In one variation, an exterior mounting receptacle 132 is similarly integrated into a single wall panel 110, such as near the lateral center of the wall panel 110.

In one example, each wall panel 110 is two-meters in width and includes an integral intra-panel exterior mounting receptacle arranged near its lateral center. In this example, exterior mounting receptacles can thus be arranged along the wall assembly on one-meter centers.

9. Variation: Horizontal Exterior Mounting Receptacle

In one variation, an exterior mounting receptacle 132 is similarly integrated—in a horizontal configuration—into: a rim joist (below and supporting a wall panel 110); a junction between a rim joist and a sill of a wall panel 110; a parapet cap (at a top of a wall panel 110); and/or a junction between a parapet cap and a top of a wall panel 110; etc.

10. Exterior Mount

The exterior building augmentation system 100 includes an exterior mount 150 configured to transiently (i.e., removably, temporarily) install in an exterior mounting receptacle and to support a functional exterior attachment 160. Generally, the exterior mount 150 can be configured to transiently couple to or support a functional exterior attachment 160. Alternatively, the exterior mount 150 and the functional exterior attachment 160 can be physically coextensive.

10.1 Pronged Exterior Mount

In one implementation shown in FIG. 1, the exterior mount 150 includes: a base 152 configured to seat against the exterior façade 140 of a wall panel 110; a left retention element 154 (or "left prong"); a right retention element 155 (or "right prong"); and an actuator 156.

In this implementation, the left retention element 154: is hinged rearward from the base 152; and includes a left return configured to insert into and extend laterally within the exterior mounting receptacle 132. The right retention element 155: is hinged rearward from the base 152 adjacent the left retention element 154; and includes a right return configured to insert into and extend laterally within the exterior mounting receptacle 132 opposite the left return. The actuator 156 is configured to transiently insert between the left retention element 154 and the right retention element 155: to expand the left return and the right return into the exterior mounting receptacle 132; and to transiently retain the base 152 on the exterior façade 140.

10.1.1 Default-Expanded Pronged Exterior Mount

In this implementation, the exterior mount 150 can include a base 152 defining: a width greater than the exterior mounting receptacle 132; and a rear face configured to seat against exterior surfaces 115 of two wall panels 110 on each side of an exterior mounting receptacle 132 when the exterior mount 150 is installed on the exterior mounting receptacle 132. In this implementation, the exterior mount 150 also includes retention elements including a pair of prongs: extending rearward from the base 152; sprung laterally outwardly from the base 152; and operable in compressed and expanded positions. In the compressed position, a total effective width of the pair of prongs is less than the width of the exterior mounting receptacle 132 in the compressed position to enable insertion and removal of the prongs from the exterior mounting receptacle 132. In this expanded position, a total effective width of the pair of prongs is greater than the width of the exterior mounting receptacle 132 in the expanded position to engage walls of the exterior mounting receptacle 132 and retain the exterior mount 150 on the exterior mounting receptacle 132. In this implementation, the exterior mount 150 further includes a release actuator (e.g., lever) manually operable to transition the prongs from the expanded position to the compressed position.

For example, exterior mount 150 can include a spring element that biases the left and right prongs outwardly to engage the exterior mounting receptacle 132, and the engagement actuator can include a clamp that draws the prongs laterally inwardly to release the prongs from the exterior mounting receptacle 132.

Therefore, in this implementation, to install the exterior mount 150 on an exterior mounting receptacle 132, a user may: withdraw the release actuator; set the base 152 over the exterior mounting receptacle 132; and release the release actuator to engage the prongs in the exterior mounting receptacle 132.

7.1.2 Default-Retracted Pronged Exterior Mount

In another implementation, the left and right prongs are sprung laterally inwardly. Accordingly, rather than a release actuator, the exterior mount 150 includes an engagement actuator (e.g., button) manually operable to transition the prongs from the compressed position to the expanded position. For example, the prongs can retract laterally inwardly in a natural state for insertion into the exterior mounting receptacle 132. In this example, the engagement actuator can include a wedge that inserts longitudinally between the prongs to drive the prongs laterally outwardly to engage and seat against interior walls of the exterior mounting receptacle 132. Therefore, in this example, tightening the engagement actuator increases retention force of the base 152 against the channel 130 and adjacent wall panels 110.

Therefore, in this implementation, to install the exterior mount 150 on an exterior mounting receptacle 132, a user may: set the base 152 over the exterior mounting receptacle 132; and depress the engagement actuator to engage the prongs in the exterior mounting receptacle 132.

7.1.3 Cam-Lock

In the foregoing implementations, the prongs can be coupled to the base 152 via a cam operable in: an extended position that locates the prongs at a first distance from the rear face of the base 152 to release the prongs from interior faces of the exterior mounting receptacle 132; and a retracted position that locates the prongs at a second distance—less than the first distance—from the rear face of the base 152 to clamp the prongs against these interior faces of the exterior mounting receptacle 132. For example, in this implementation, the cam can include a shaft extending laterally across the base 152, and the prongs can be eccentrically and pivotably coupled to the shaft. In this example, the exterior mount 150 can further include a cam lever couple to the shaft, accessible from the front of side of the base 152, and configured to rotate shaft between extended and retracted angular positions.

Furthermore, in the foregoing implementation in which the prongs are sprung laterally inwardly, the exterior mount 150 can include a fixed wedge proximal the shaft such that rotation of the shaft from the extended position to the retracted position can move the prongs—eccentrically coupled to the shaft—across the wedge, which expands the prongs to across the exterior mounting receptacle 132 as the shaft draws the prongs longitudinally inwardly to clamp the exterior mounting receptacle 132 and exterior surfaces 115 of the wall panels 110 between the prongs and the rear face of the base 152.

7.1.4 Longitudinal Cam Exterior Mount

In another implementation, an exterior mount 150 includes: an base 152 as described above; and a boss extending rearward from the base 152 and configured to locate in an exterior mounting receptacle 132. In this implementation, the exterior mount 150 can also include a set of cam lobes: mounted to the boss; operable in a) a retracted position to pass through the exterior mounting receptacle 132 and b) an expanded position to expand laterally past the exterior mounting receptacle 132 and engage interior walls of the exterior mounting receptacle 132; and sprung in the expanded position. In this implementation, the exterior mount 150 can further include: a cam actuator (e.g., a set of cables): manually accessible from a front or side of the base 152; and configured to transition the set of cam lobes from the expanded position into the retracted position.

Therefore, in this implementation, to install the exterior mount 150 on an exterior mounting receptacle 132, a user may: withdraw the cam actuator; set the base 152 over the exterior mounting receptacle 132; insert the boss in the exterior mounting receptacle 132 of the exterior mounting receptacle 132; and release the cam actuator to engage the cam lobes in the exterior mounting receptacle 132.

7.1.5 Rotary Lobe Exterior Mount

In another implementation, an exterior mount 150 includes: an base 152 as described above; a shaft extending longitudinally through the rear face of the base 152; and a pair of lobes defining wedge profiles and extending laterally in opposing directions from the rear of the shaft.

In this implementation, to install the exterior mount 150 on an exterior mounting receptacle 132, a user may: rotate the shaft to locate the lobes in a vertical (e.g., 90° and 270°) orientation; set the base 152 over the exterior mounting receptacle 132; insert the shaft and lobes into the exterior mounting receptacle 132 of the exterior mounting receptacle 132; and rotate the shaft 90° to engage the lobes against the inner faces of the exterior mounting receptacle 132.

In this implementation, the exterior mount 150 can further include: shaft stops between 0° and 90° positions; and a spring element configured to bias the shaft toward the front face of the base 152 and absorb inconsistent depths between exterior faces of wall panels 110 and interior faces of the exterior mounting receptacles 132 when the exterior mount 150 is moved between different exterior mounting receptacles over time.

However, the exterior mount 150 can define any other interface or element operable in any other way to transiently connect the exterior mount 150 to the exterior mounting receptacle 132 and adjacent wall panels 110.

7.2 J-Plates

In another implementation shown in FIGS. 3 and 4, the exterior mount 150 includes: a left retention element 154; a right retention element 155; and a fastener 158. In this implementation, the left retention element 154 defines: a left return configured to insert into and extend laterally within the exterior mounting receptacle 132; and a left bracket coupled to the left return and configured to extend outwardly from the exterior façade 140. The right retention element 155 defines: a right return configured to insert into and extend laterally within the exterior mounting receptacle 132 opposite the left return; and a right bracket coupled to the right return and configured to extend outwardly from the exterior façade 140. The fastener 158 is configured to clamp the left retention element 154 to the right retention element 155, thereby constraining (or "locking") the left return and the right return within the exterior mounting receptacle 132.

Thus, in this implementation, a user may insert the left return of the left retention element 154 into the exterior mounting receptacle 132 and rotate the left retention element 154 such that the left bracket extends outwardly from and normal to the exterior surfaces 115 of the wall panels 110 that form the exterior mounting receptacle 132. The user may then similarly: insert the right return of the right retention element 155 into the exterior mounting receptacle 132 below the left retention element 154; rotate the right retention element 155 such that the right bracket extends outwardly from and normal to the exterior surfaces 115 of these wall panels 110; draw the right retention element 155 up the exterior mounting receptacle 132 to meet the left retention element 154 (or vice versa); and then pass and assemble the fastener 158 through bores in the left and right retention elements 155 to assemble the exterior mount 150 to the exterior mounting receptacle 132.

7.3 Electrically-Isolated Exterior Mount Features

In the variation described above in which an exterior mounting receptacle is electrified, the retention elements (e.g., prongs, cam lobes) on the exterior mount 150: can be electrically isolated; can include conductive tips configured to engage electrically-isolated ground and voltage-supply regions of an exterior mounting receptacle 132; and can be electrically coupled (e.g., via electrical wires running through the prongs) to electrical contacts within the base and/or within a functional element coupled to the base.

8. Mechanical Exterior Attachment

The exterior building augmentation system 100 can further include a functional exterior attachment 160, such as a mechanical exterior attachment 160 extending from or configured to couple to the base of the exterior mount 150, such as opposite prongs or cams that retain the exterior mount 150 on an exterior mounting receptacle 132.

In this implementation, a mechanical exterior attachment 160 can be configured to bolt to, clamp to, screw into, or otherwise assemble onto an exterior mount 150. Alternatively, the mechanical exterior attachment 160 and the exterior mount 150 can be physically coextensive and form a single (e.g., inseparable) assembly.

8.1 Hose Exterior Attachment

In one example, the mechanical exterior attachment 160 includes a hose bib: mounted to the base; and configured to receive a water supply line—such as a polymer water line connected with a threaded or crimp line fitting—from a water main in the building. Thus, in this example, a user may: install a hose bib attachment at a preferred vertical position in a preferred exterior mounting receptacle; route an ultraviolet-resistant flexible water line from a water main in the building to the hose bib attachment; connect the flexible water line to the hose bib attachment; depress and hide the flexible water line in this exterior mounting receptacle; and retain the flexible water line in this exterior mounting receptacle with a set of clips inserted into the exterior mounting receptacle 132. The user may later move the hose bib attachment to another location on the building by reversing and then repeating this process, such as if the user's exterior water supply needs change.

8.2 Stair Attachment

In another example, the mechanical exterior attachment 160 includes a stair assembly: spanning the pitch distance between exterior mounting receptacles on the building; including a first step defining a first end mounted to a first base and a second end mounted to a second base; including a riser; and including a second step coupled to the riser below the first step. Thus, in this example, a user may install the stair assembly below an exterior door and in two adjacent exterior mounting receptacles on the building to form exterior stairs extending from and mounted to the building (e.g., rather than supported off of a ground area adjacent the building). The user may later move the stair assembly to another location on the building, such as if the user constructs a more permanent entry into the building or reconfigures wall panels 110 of the building to move this exterior door to a different location.

In the foregoing example, a second exterior mount 150 includes: a cable stay extending from the base and configured to mount to an exterior mounting receptacle 132 above a lateral end of the stair assembly; and a tension cable extending from the cable stay to a distal end of the stair assembly and configured to further support the distal ends of the stair assembly. Thus, in this example, a user may install a second exterior mount 150 above each lateral side of the stair assembly and connect cables between these second exterior mounts 150 and the distal ends of the stair assembly in order to further support the stair assembly thus cantilevered from the building.

8.3 Banister Attachment

In a similar example shown in FIG. 2, the functional exterior attachment 160 can include a banister 162 configured to transiently: install on the exterior mount 150; and extend from the exterior façade 140—formed by a series of wall panels 110—above a deck surface (e.g., a stair assembly) adjacent the first wall panel 110. In particular, in this example, the exterior mount 150 can be located in an exterior mounting receptacle locate over an adjacent an edge of a deck surface or stair assembly; and a proximal end of the banister 162 or railing system can be installed on the exterior mount 150. The exterior mount 150 can thus locate and support the project end of the banister 162 on the exterior mounting receptacle 132, such as without necessitating drilling into or other perforation of the exterior surfaces 115 of wall panels 110 of the structure. A distal end of the banister 162 or railing system can similarly be supported by a column or balustrade extending upwardly from the deck surface or stair assembly.

8.4 Shelf/Table Attachment

In a similar example, the functional exterior attachment 160 includes a shelf or table: spanning the pitch distance between exterior mounting receptacles on the building; and including a horizontal surface defining a first end mounted to a first base and a second end mounted to a second base. Thus, in this example, a user may install the shelf or table attachment in two adjacent exterior mounting receptacles on the building to form an exterior shelf or work surface extending from and mounted to the building (e.g., rather than supported off of a ground area adjacent the building). The user may later move the shelf or table attachment to another location on the building, such as to accommodate different work or storage needs around the building over time. In this example, the user may also install a second exterior mount 150, as described above, above each lateral side of the shelf or table attachment and connect cables between these second exterior mounts 150 and the distal ends of the shelf or table attachment in order to further support the shelf or table attachment cantilevered from the building.

8.5 Bin Attachment

In a similar example, the functional exterior attachment 160 includes a bin (e.g., trash bin, recycling bin, composting bin, storage bin), a drum, a cabinet, or other storage container mounted to a set of (i.e., one or more) bases. A user may install an exterior mounting receptacle on one exterior mounting receptacle or install two exterior mounting receptacles across two adjacent exterior mounting receptacles on the building, as described above, and then locate the storage attachment on the exterior mounting receptacle 132 (s), thereby suspending the storage attachment without necessitating drilling into or other perforation of the exterior surfaces 115 of wall panels 110 of the structure.

8.6 Hook Attachment

In a similar example, the functional exterior attachment 160 includes an integral hook, loop, or other coupler extending from the base. A user may thus: install the integral coupler attachment on an exterior mounting receptacle 132 on the building, as described above; and store a rake, broom, bicycle, or other implement on the integral coupler attachment.

For example, the exterior mount 150 can be configured to transiently insert into and fasten against the exterior mounting receptacle 132 between two wall panels 110. The functional exterior attachment 160 includes a bicycle rack 169 configured to transiently install on the exterior mount 150 and to hang a bicycle on the exterior façade 140. The exterior mounting receptacle 132 and the bicycle rack 169 can thus cooperate to enable the user to hang and store a bicycle on a side of the structure without drilling into or otherwise perforating the exterior surfaces 115 of these wall panels 110.

In a similar example, the exterior mount 150 can be configured to transiently insert into and fasten against the exterior mounting receptacle 132 between two wall panels 110. The functional exterior attachment 160 includes a tool rack 171 configured to transiently install on the exterior mount 150 and to hang gardening tools, such as a rake, shovel, and hoe. The exterior mounting receptacle 132 and the tool rack 171 can thus cooperate to enable the user to hang and store a suite of gardening tools on a side of the structure without drilling into or otherwise perforating the exterior surfaces 115 of these wall panels 110.

8.7 Universal Attachment

In another example shown in FIG. 2, the functional exterior attachment 160 includes a composite or wood base that forms a generic or "universal" mount. A user may: install an exterior mount 150 on an exterior mounting receptacle on the building, as described above; locate the universal attachment on the exterior mount 150; and then screw or nail objects to the composite or wood base, such as a bird house, a hook, a house number plate, a doorknocker, or a bell, etc.

More specifically, the universal attachment can include a wood or composite element configured to: receive a nail in place of a fastener driven into the first wall panel 110 and the second wall panel 110; transiently install on the exterior mount 150; and hang an object on the exterior mounting receptacle 132 between the first wall panel 110 and the second wall panel 110. The exterior mount 150 and the universal attachment can thus enable the user to screw or nail objects to the structure without perforating the exterior surfaces 115 of the wall panel 110 or otherwise damaging the wall panels 110.

9. Electrical Attachment

In another implementation, the functional exterior attachment 160 includes an electrical exterior function element.

In this implementation, an electrical exterior attachment 160 can be configured to bolt to, clamp to, screw into, or otherwise assemble onto an exterior mount 150. Alternatively, the electrical exterior attachment 160 and the exterior mount 150 can be physically coextensive and form a single (e.g., inseparable) assembly.

8.1 Light Element

In one example shown in FIGS. 1 and 2, the electrical exterior attachment 160 and the exterior mount 150 forms a lighting attachment including a light element 163 (e.g., an LED): arranged in a lamp housing mounted to the base of the exterior mount 150; and electrically coupled to the retention elements extending rearward from the base of the exterior mount 150. Therefore, when the lighting attachment is installed on an exterior mounting receptacle, the light element 163 is electrically coupled to a power supply in the building via isolated conductive surfaces within the exterior mounting receptacle 132 and the retention elements. Thus, in this example, a user may install a lighting attachment at a preferred vertical position in a preferred exterior mounting receptacle on the building, such as adjacent an exterior door or over an exterior patio. The user may then activate the light element 163 in the lighting attachment by: selectively activating an electrical supply to the exterior mounting receptacle 132; actuating a mechanical switch integral in the lighting attachment (e.g., if the electrical supply to the exterior mounting receptacle 132 is permanently or semi-permanently active); and/or actuating a switch within the lighting attachment via wireless control (e.g., via a smartphone or other wireless controller). The user may later move the lighting attachment to another location on the building by reversing and then repeating this process, such as if the user's exterior lighting needs change.

In another variation, the exterior mounting receptacle 132 excludes electrical connections or contacts, and a floor panel 170 (or wall panel 110) adjacent the exterior mounting receptacle 132 includes an electrical receptacle, such as a switched electrical receptacle arranged under (e.g., facing downwardly from) the floor panel 170. In this and other examples described herein, the lighting attachment can include: an electrical cord electrically coupled to the light element 163 and configured to insert into and to be retained by the exterior mounting receptacle 132; and an electrical plug coupled to the electrical cord and configured to insert into the electrical receptacle arranged under the floor panel 170. Thus, in this example and others described, the electrical exterior attachment 160 can be powered via an electrical receptacle separate from the exterior mounting receptacle 132.

8.2 Auxiliary Gadgets

In other examples, the electrical exterior attachment 160 similarly includes: a wireless speaker; a television; or a fan. When the electrical exterior attachment 160 is installed on an exterior mounting receptacle 132, the speaker, television, fan, or doorbell 167 (e.g., a wireless doorbell 167) is electrically coupled to a power supply in the building via isolated conductive surfaces within the exterior mounting receptacle 132 and the retention elements. Accordingly, the user may install and later move this electrical exterior attachment 160 to various locations on the building, such as if the user's exterior sound, entertainment, or airflow needs change.

8.2 Electrical Outlet

In another example, the functional exterior attachment 160 includes an electrical outlet and forms a generic electrical outlet attachment. A user may install the generic electrical outlet attachment on an exterior mounting receptacle 132 on the building, as described above, and connect other devices to this electrical outlet in the generic electrical outlet, such as: to recharge a battery-operated phone or other device; or to power a wired electrical yard tool or cooking implement.

8.3 Solar Panel

In another example shown in FIG. 2, the electrical exterior attachment 160 forms a solar attachment including a solar panel 161 configured to mount (or integrated into) the exterior mount 150 and configured to electrically couple to the retention elements of the exterior mount 150. Therefore, when the solar attachment is installed on an exterior mounting receptacle, the solar panel 161 is outwardly offset from the exterior façade 140 of the structure, and is electrically coupled to the isolated conductive surfaces within the exterior mounting receptacle 132 via the retention elements of the exterior mount 150. In this example, a user may install another electrical exterior attachment 160—such as a lighting attachment or generic electrical outlet attachment—to the same exterior mounting receptacle such that this electrical exterior attachment 160 is powered by the solar attachment directly via the isolated conductive surfaces within the exterior mounting receptacle 132.

Alternatively, the solar attachment can supply electrical power to the structure via these isolated conductive surfaces or via an electrical cord coupling the solar attachment to an electrical receptacle arranged on a nearby floor panel 170 or wall panel 110, as described above. For example, in one implementation in which the exterior mounting receptacle 132 is also connected to a main power supply in the building, the solar attachment can supply additional DC electrical power to the main power supply in the building. Thus, in this implementation, a user may install a solar attachment in a particular exterior mounting receptacle on the building to augment the main power supply in the building. The user may also move the solar attachment to different exterior mounting receptacles on the building over time, such as to increase energy capture by the solar attachment during different seasons.

In another implementation in which the exterior mounting receptacle 132 is not connected to the main power supply in the building, the solar attachment can supply DC electrical power to the exterior mounting receptacle 132, which functions as a power bus for communicating DC electrical power from the solar attachment to other attachments—including electrical elements—installed on the same exterior mounting receptacle. Thus, in this implementation, a user may: install a lighting attachment in a particular exterior mounting receptacle on the building, such as adjacent an exterior door or over an exterior patio; and install a solar attachment in this exterior mounting receptacle in order to supply power the lighting attachment via this exterior mounting receptacle. The user may also move the solar and lighting attachments to different exterior mounting receptacles on the building over time, such as to accommodate different exterior lighting needs during different seasons or for different outdoor activities.

9. Wall Panel Augmentation

Figure 6:
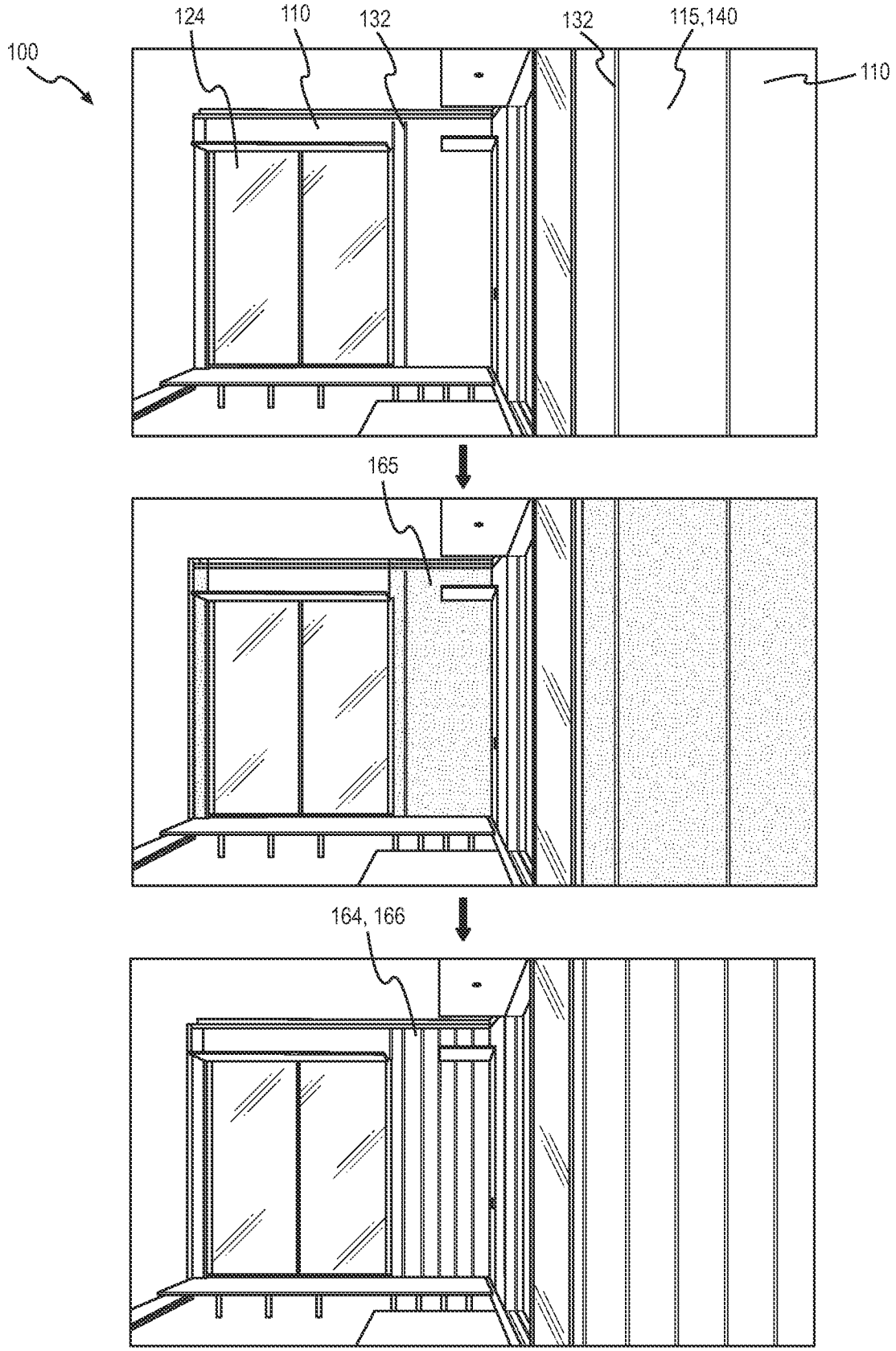
FIG. 6 is a flowchart representation of one variation of the system.

In another implementation shown in FIGS. 5 and 6, a functional exterior attachment 160 includes a secondary exterior configured to locate on a set of exterior mounts 150 and to partially or fully enclose the exterior surface 115 of one or more wall panels 110, such as: to augment an aesthetic of the exterior surfaces 115 of these wall panels 110; to supplant the aesthetic of the exterior surfaces 115 of these wall panels 110; to increase rain-shedding capacity of the structure (e.g., in high-wind and high-rainfall environments); and/or to increase thermal insulation (or "R-value") of the structure.

9.1 Ornamental Exterior Cladding Panel

In one example shown in FIGS. 5 and 6, the functional exterior attachment 160 includes an ornamental exterior cladding panel 165 configured to augment an existing aesthetic of the exterior surface 115 of a wall panel 110.

In this example, the exterior surface 115 of a wall panel 110 can include a first material defining a first color and a first texture, such as a fiberglass panel coated with a solid, continuous, matte paint (e.g., white, black) to form the exterior surface 115 of the wall panel 110. Conversely, the exterior cladding panel can include a second material defining a second color and a second texture different from the exterior surface 115 of the wall panel 110, such as: a wood lattice structure in walnut or redwood and defining an array of apertures characterized by an open area between 30% and 70%; or a perforated aluminum panel defining an array or circular, square, or hexagonal, etc. apertures characterize by an open area between 40% and 80%.

A user may therefore install a second set of exterior mounts 150 in exterior mounting receptacles on each side of the wall panel 110, such as four exterior mounts 150, each proximal a corner of the wall panel 110. The user may then locate the exterior cladding panel on these exterior mounts 150, which thus locate the exterior cladding panel on the structure outwardly offset from the exterior surface 115 of the wall panel 110. The array of apertures in the exterior cladding panel can thus expose regions of the exterior surface 115 of the wall panel 110 and therefore augment the aesthetic of this exterior surface 115.

In this and other examples described herein, each exterior mount 150 can include a horizontal pin or retainer configured to locate adjacent (and outwardly offset from) the exterior surface 115 of a wall panel 110 when the exterior mount 150 is installed in the adjacent exterior mounting receptacle. The exterior cladding panel can include a set of rear-facing mounting hooks or latches, such as two mounting hooks extending rearward from each upper corner of the exterior cladding panel or four mounting hooks extending rearward from the upper and lowers corners of the exterior cladding panel. Therefore, a user may install one or two exterior mounts 150 in the exterior mounting receptacles 132 on each side of a wall panel 110 and then locate the mounting hooks of the exterior cladding panel over the horizontal pins of these exterior mounts 150. The user may further pass a bolt, pin, or other fastener or retainer through corresponding bores of a) shoulders in the upper and/or lower mated pairs of exterior mounts 150 and b) the corresponding mounting hook(s) located on the exterior cladding panel, thereby positively constraining the exterior cladding panel to the structure. However, the exterior mounts 150 can be configured to locate and retain the exterior cladding panel in any other way.

In this and other examples described herein, an exterior mount 150 can also be configured to locate a single exterior cladding panel and/or a pair of adjacent exterior cladding panels. Accordingly, the user may install six exterior mounts 150 across three adjacent exterior mounting receptacles and then locate two exterior cladding panels across these six exterior mounts 150 to augment aesthetics of the exterior surfaces 115 of these two wall panels 110; etc.

9.2 Rainscreen Panel

In one example shown in FIG. 6, the functional exterior attachment 160 includes an exterior rainscreen panel 166 configured to locate over an exterior surface 115 of a wall panel 110 in a rainscreen configuration. In particular, in this example, the exterior rainscreen panel can include: a continuous outer panel outwardly offset from the exterior surface 115 of the wall panel 110; a lower vent located below the continuous outer panel; and an upper vent located above the continuous outer panel and cooperating with the lower vent to vent moisture from behind the continuous outer panel.

In this example, the continuous outer panel can fully enclose (i.e., cover, obfuscate) the exterior surface 115 of the wall panel 110 and can thus include a material, color, and/or texture similar or dissimilar to that of the exterior surface 115 of the wall panel 110. For example, the exterior rainscreen panel can include a folded and/or fabricated rectilinear, five-sided sheet metal structure—such as formed of 24-gage powder coated steel or 18-gage anodized aluminum—configured to hang on a set of (e.g., two, four) exterior mounts 150.

In this example, the exterior rainscreen panel can be mounted to a wall panel 110 via a set of exterior mounts 150, as described above, without necessitating drilling into or other perforation of the exterior surfaces 115 of wall panels 110 of the structure.

9.3 Exterior Insulation Augmentation Panel

In another example shown in FIG. 6, the functional exterior attachment 160 includes an exterior insulation augmentation panel 164 configured to locate over an exterior surface 115 of a wall panel 110 and to augment the wall panel 110 with additional insulation.

In particular, in this example, a wall panel 110 can further include an insulative element 119 extending between its left column element 111, right column element 112, header element 114, and footer element 113, such as a cast-in-place closed-cell foam characterized by an insulative value of R-26. The exterior insulation augmentation panel can include: a continuous outer panel; and a second insulative element 119 located behind the continuous outer panel, such as a pre-cat rigid foam sheet characterized by an insulative value of R-13.

In this example, the continuous outer panel can fully enclose (i.e., cover, obfuscate) the exterior surface 115 of the wall panel 110 and can thus include a material, color, and/or texture similar or dissimilar to that of the exterior surface 115 of the wall panel 110. For example, the exterior insulation augmentation panel can include: a folded and/or fabricated rectilinear, five-sided sheet metal structure—such as formed of 24-gage powder coated steel or 18-gage anodized aluminum—configured to hang on a set of (e.g., two, four) exterior mounts 150; and a rigid foam panel bonded to the interior of this sheet metal structure.

In this example, the exterior insulation augmentation panel can be mounted to a wall panel 110 via a set of exterior mounts 150, as described above, to increase the effective insulative value of the wall panel 110 to R-39 and without necessitating drilling into or other perforation of the exterior surfaces 115 of wall panels 110 of the structure and without modification to the interior of the structure.

9.4 Awning

In another example, the functional exterior attachment 160 includes an exterior awning element configured to locate on a wall panel 110 and to shade a fenestration 124 (e.g., a window, a door) from sunlight and precipitation.

For example, a wall panel 110 can include: a left column element 111 configured to carry vertical loads through a left side of the wall panel 110; a right column element 112 configured to carry vertical loads through a right side of the wall panel 110; a footer element 113 extending between the left column element 111 and the right column element 112 and configured to seat on a floor panel 170; and a header element 114 extending between the left column element 111 and the right column element 112 above the footer element 113. The wall panel 110 can further include a fenestration 124 element—such as a window or door—located between the left column element 111 and the right column element 112.

The exterior awning element can include: a rigid cantilevered structure enclosed with a fiberglass or aluminum panel; a rigid frame enclosed with a tensioned fabric; or a perforated or slatted structure. Thus, a user may: install an exterior mount 150 near the top of each exterior mounting receptacle located on each side of the wall panel 110; and then install the exterior awning element on these exterior mounts 150, thereby completing installation of an awning over the fenestration 124 without necessitating drilling into or other perforation of the exterior surfaces 115 of wall panels 110 of the structure. For example, the user may: install the exterior mounts 150 and the exterior awning element over a west-facing window during summer months in order to reduce solar heating of the structure through this window; and later move these exterior mounts 150 and the exterior awning element over an entry door during winter months in order to shield this entry door from precipitation.

10. Exterior Flange

Figure 9:
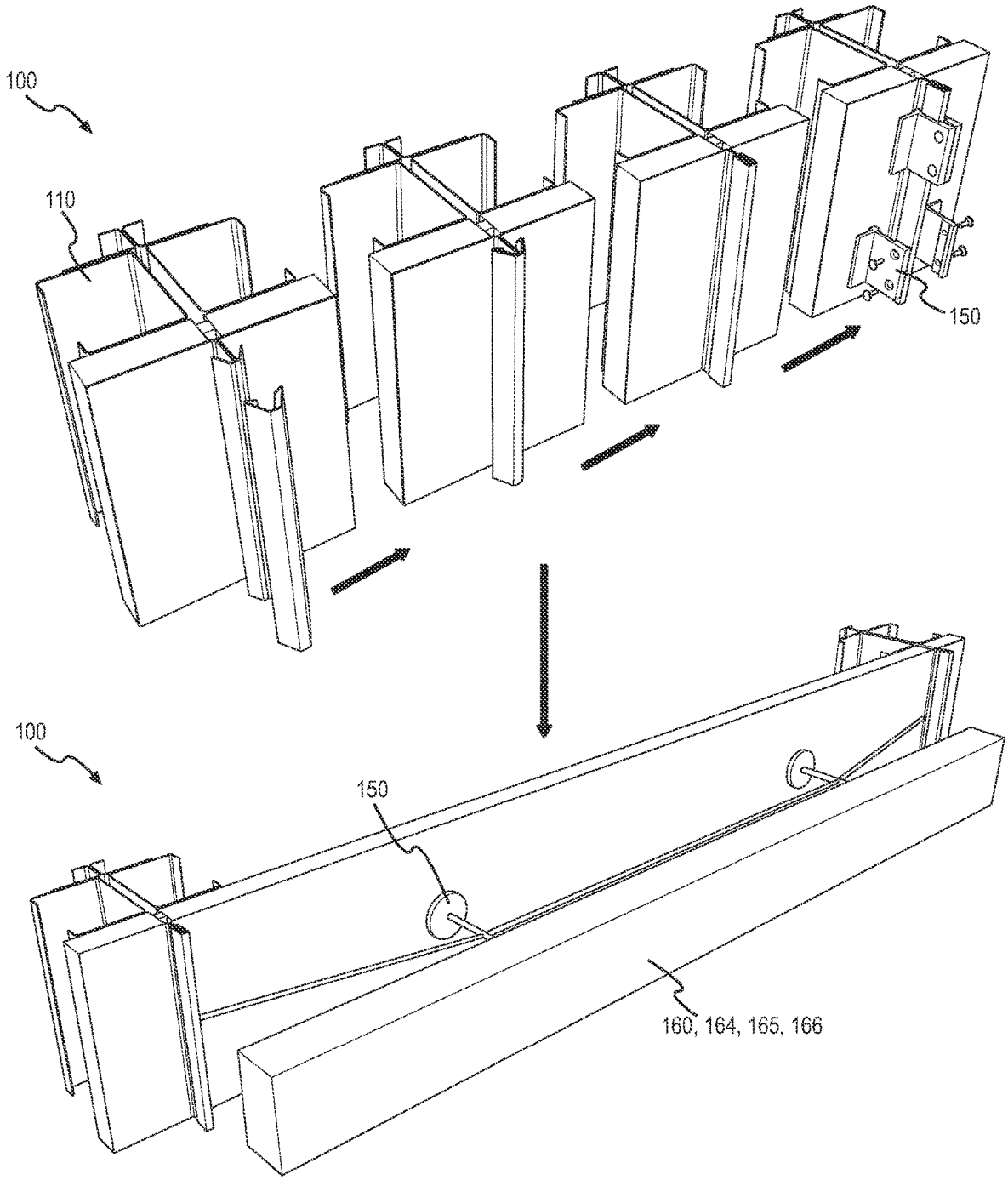
FIG. 9 is a flowchart representation of one variation of the system.

In one variation shown in FIG. 9, each wall panel 110 includes an exterior-facing crimp or clinch flange configured to abut and mate with an adjacent exterior-facing crimp or clinch flange of an adjacent wall panel 110. In this variation, the exterior mount 150 is configured to locate over and to lock against this crimp or clinch flange and to hang or otherwise locate an exterior attachment 160 from this crimp or clinch flange.

As a person skilled in the art will recognize from the previous detailed description and from the figures and claims, modifications and changes can be made to the embodiments of the invention without departing from the scope of this invention as defined in the following claims.

We claim:

1. A building system comprising:

a first wall panel configured to install on a floor panel adjacent a second wall panel and comprising:

a first left column element:

configured to carry vertical loads through a left side of the first wall panel;

a first right column element:

configured to carry vertical loads through a right side of the first wall panel;

a first footer element:

extending between the first left column element and the first right column element; and configured to seat on the floor panel;

a first header element:

extending between the first left column element and the first right column element above the first footer element;

a first exterior surface extending across the first left column element and the first right column element;

a first left channel section:

coupled to the first left column element; and recessed behind the first exterior surface;

a first left clinch flange:

extending rearward from the first left column element opposite the first exterior surface; and laterally offset from the first left column element toward the second wall panel; and a first left return flange extending laterally from the first left clinch flange, opposite the second wall panel, to stiffen the first left clinch flange; and the second wall panel configured to install on the floor panel adjacent the first wall panel and comprising:

a second right column element configured to abut the first left column element of the first wall panel;

a second exterior surface:

extending across the second right column element; and cooperating with the first exterior surface of the first wall panel to form an exterior façade;

a second right channel section:

coupled to the second right column element;

recessed behind the second exterior surface; and cooperating with the first left channel section to define an exterior mounting receptacle:

facing outwardly from the second wall panel;

extending vertically between the first wall panel and the second wall panel;

recessed behind the exterior façade; and retaining an exterior mount, the exterior mount locating an exterior attachment over the exterior façade;

a second right clinch flange:

extending rearward from the second right column element opposite the second exterior surface; and configured to mate to the first left clinch flange of the first wall panel via a series of clinch connections:

to assemble the second wall panel to the first wall panel; and to locate the second right channel section adjacent the first left channel section to form the exterior mounting receptacle; and a second right return flange extending laterally from the second right clinch flange, opposite the first wall panel, to stiffen the second right clinch flange.

2. The building system of claim 1, wherein the exterior mount comprises:

a left retention element defining:

a left return configured to insert into and extend laterally within the exterior mounting receptacle; and a left bracket coupled to the left return and configured to extend outwardly from the exterior façade;

a right retention element defining:

a right return configured to insert into and extend laterally within the exterior mounting receptacle opposite the left return; and a right bracket coupled to the right return and configured to extend outwardly from the exterior façade; and a fastener configured to clamp the left retention element to the right retention element to constrain the left return and the right return within the exterior mounting receptacle.

3. The building system of claim 1, wherein the exterior mount comprises:

a base configured to seat against the exterior façade;

a left retention element:

hinged rearward from the base; and comprising a left return configured to insert into and extend laterally within the exterior mounting receptacle;

a right retention element:

hinged rearward from the base adjacent the left retention element; and comprising a right return configured to insert into and extend laterally within the exterior mounting receptacle opposite the left return; and an actuator configured to transiently insert between the left retention element and the right retention element:

to expand the left return and the right return into the exterior mounting receptacle; and to transiently retain the base on the exterior façade.

4. The building system of claim 1:

wherein the first exterior surface defines a first color and a first texture;

wherein the exterior mount is configured to transiently insert into and fasten against the exterior mounting receptacle; and wherein the exterior attachment comprises a secondary exterior cladding panel:

defining a second color and a second texture, the second material different from the first material, the second color different from the first color, and the second texture different from the first texture; and configured to transiently install over and enclose the first exterior surface by coupling to the exterior mount.

5. The building system of claim 4:

wherein the first exterior surface comprises a continuous painted surface; and wherein the secondary exterior cladding panel comprises a wood lattice structure defining an array of apertures configured to expose regions of the first exterior surface located behind the secondary exterior cladding panel.

6. The building system of claim 4, wherein the secondary exterior cladding panel:

is configured to locate over the first exterior surface in a rainscreen configuration; and comprises:

a continuous outer panel outwardly offset from the first exterior surface;

a lower vent located below the continuous outer panel; and an upper vent located above the continuous outer panel and cooperating with the lower vent to vent moisture located behind the continuous outer panel.

7. The building system of claim 1:

wherein the first wall panel further comprises a first insulative element extending between the first left column element, the first right column element, the first header element, and the first footer element;

wherein the exterior mount is configured to transiently insert into and fasten against the exterior mounting receptacle; and wherein the exterior attachment comprises a secondary exterior cladding panel:

configured to transiently install over and enclose the first exterior surface by coupling to the exterior mount; and comprising a second insulative element configured to augment the first insulative element of the first wall panel.

8. The building system of claim 1:

wherein the second wall panel comprises:

a second left column element:

configured to carry vertical loads through a left side of the second wall panel;

a second footer element:

extending between the second left column element and the second right column element; and configured to seat on the floor panel adjacent the first wall panel;

a second header element:

extending between the second left column element and the second right column element above the second footer element; and a fenestration element located between the second left column element and the second right column element;

wherein the exterior mount is configured to transiently insert into and fasten against the exterior mounting receptacle; and wherein the exterior attachment comprises an awning element configured to transiently:

install on the exterior mount; and extend across the second wall panel over the fenestration element.

9. The building system of claim 1:

wherein the exterior mount is configured to transiently insert into and fasten against the exterior mounting receptacle; and wherein the exterior attachment comprises a universal mount comprising a wood element configured to:

receive a nail in place of a fastener driven into the first wall panel and the second wall panel;

transiently install on the exterior mount; and hang an object on the exterior mounting receptacle between the first wall panel and the second wall panel.

10. The building system of claim 1:

wherein the exterior mount is configured to transiently insert into and fasten against the exterior mounting receptacle; and wherein the exterior attachment comprises a solar panel configured to transiently install on the exterior mount outwardly offset from the exterior façade.

11. The building system of claim 1:

wherein the exterior mount is configured to transiently insert into and fasten against the exterior mounting receptacle; and wherein the exterior attachment comprises a banister configured to transiently:

install on the exterior mount; and extend from the exterior façade above a deck surface adjacent the first wall panel.

12. The building system of claim 1, wherein the exterior mount:

is configured to transiently insert into and fasten against the exterior mounting receptacle; and comprises a light element configured to illuminate the exterior façade.

13. The building system of claim 12, wherein the exterior mount further comprises:

an electrical cord configured to insert into the exterior mounting receptacle; and an electrical plug coupled to the electrical cord and configured to insert into an electrical receptacle arranged under the floor panel.

14. The building system of claim 1, wherein the exterior mount:

is configured to transiently insert into and fasten against the exterior mounting receptacle; and comprises a wireless doorbell.

15. A building system comprising:

a first wall panel:

configured to install on a floor panel adjacent a second wall panel; and comprising:

a left column element:

configured to carry vertical loads through a left side of the first wall panel; and configured to abut a right column element of the second wall panel;

a footer element:

supporting the left column element; and configured to seat on the floor panel;

a header element:

supported above the footer element by the left column element;

a first exterior surface:

extending across the left column element; and cooperating with a second exterior surface of the second wall panel to form an exterior façade; and a left channel section:

coupled to the left column element;

recessed behind the first exterior surface; and cooperating with a right channel section of the second wall panel to define an exterior mounting receptacle:

facing outwardly from the first wall panel;

extending vertically between the first wall panel and the second wall panel;

recessed behind the exterior façade; and configured to transiently retain an exterior mount;

the exterior mount comprising:

a left retention element defining:

a left return configured to insert into and extend laterally within the exterior mounting receptacle; and a left bracket coupled to the left return and configured to extend outwardly from the exterior façade;

a right retention element defining:

a right return configured to insert into and extend laterally within the exterior mounting receptacle opposite the left return; and a right bracket coupled to the right return and configured to extend outwardly from the exterior façade; and a fastener configured to clamp the left retention element to the right retention element to constrain the left return and the right return within the exterior mounting receptacle; and an exterior attachment configured to transiently:

install on the exterior mount; and extend from the exterior façade.

16. The building system of claim 15, wherein the exterior attachment is selected from a kit of exterior attachments comprising:

a light element configured to illuminate the exterior façade;

a solar panel;

an awning element configured to locate over a fenestration element within the second wall panel;

a banister configured to extend from the exterior façade above a deck surface adjacent the first wall panel;

a rainscreen exterior façade panel configured to locate over and conceal the exterior façade;

an external ornamentation panel configured to locate over the exterior façade and defining an array of apertures configured to exposure regions of the exterior façade; and an insulation panel configured to locate over the first wall panel and to augment insulation in the first wall panel.

17. A building system comprising:

a first wall panel configured to install on a floor panel adjacent a second wall panel and comprising:

a first left column element configured to carry vertical loads through a left side of the first wall panel;

a first right column element configured to carry vertical loads through a right side of the first wall panel;

a first footer element extending between the first left column element and the first right column element and configured to seat on the floor panel;

a first header element extending between the first left column element and the first right column element above the first footer element;

a first exterior surface extending across the first left column element and the first right column element;

a first left channel section coupled to the first left column element and recessed behind the first exterior surface;

a first left clinch flange extending rearward from the first left column element opposite the first exterior surface and laterally offset from the first left column element toward the second wall panel; and a first left return flange extending laterally from the first left clinch flange, opposite the second wall panel, to stiffen the first left clinch flange; and the second wall panel comprising:

a second right column element configured to abut the first left column element of the first wall panel;

a second exterior surface extending across the second right column element and cooperating with the first exterior surface of the first wall panel to form an exterior façade;

a second right channel section:

coupled to the second right column element;

recessed behind the second exterior surface; and cooperating with the first left channel section to define an exterior mounting receptacle:

facing outwardly from the second wall panel;

extending vertically between the first wall panel and the second wall panel;

recessed behind the exterior façade;

located between a gasket, and compressed between a left face of the first left column element and a right face of the second right column element, and the exterior façade; and retaining an exterior mount, the exterior mount locating an exterior attachment over the exterior façade;

a second right clinch flange:

extending rearward from the second right column element opposite the second exterior surface;

laterally offset from the second right column element toward the first wall panel; and configured to mate to the first left clinch flange of the first wall panel, via a series of clinch connections:

to assemble the second wall panel to the first wall panel;

to locate the second right channel section adjacent the first left channel section to form the exterior mounting receptacle; and to form a seal receptacle between the left face of the first left column element and the right face of the second right column element; and a second right return flange extending laterally from the second right clinch flange, opposite the first wall panel, to stiffen the second right clinch flange.

18. A building system comprising:

a first wall panel configured to install on a floor panel and comprising:

a first left column element configured to carry vertical loads through a left side of the first wall panel;

a first right column element configured to carry vertical loads through a right side of the first wall panel;

a first footer element extending between the first left column element and the first right column element and configured to seat on the floor panel;

a first header element extending between the first left column element and the first right column element above the first footer element;

a first exterior surface extending across the first left column element and the first right column element; and a first left channel section coupled to the first left column element and recessed behind the first exterior surface;

a second wall panel configured to install on the floor panel adjacent the first wall panel and comprising:

a second right column element configured to abut the first left column element of the first wall panel;

a second exterior surface extending across the second right column element and cooperating with the first exterior surface of the first wall panel to form an exterior façade; and a second right channel section:

coupled to the second right column element;

recessed behind the second exterior surface; and cooperating with the first left channel section to define an exterior mounting receptacle:

facing outwardly from the second wall panel;

extending vertically between the first wall panel and the second wall panel;

recessed behind the exterior façade; and retaining an exterior mount, the exterior mount locating an exterior attachment over the exterior façade;

the exterior mount configured to transiently insert into and fasten against the exterior mounting receptacle; and the exterior attachment comprising a bicycle rack configured to transiently:

install on the exterior mount; and hang a bicycle on the exterior façade.

19. A building system comprising:

a first wall panel configured to install on a floor panel adjacent a second wall panel and comprising:

a first left column element configured to carry vertical loads through a left side of the first wall panel;

a first left channel section coupled to the first left column element and recessed behind a first exterior surface of the first wall panel;

a first left clinch flange extending rearward from the first left column element opposite the first exterior surface and laterally offset from the first left column element toward the second wall panel; and a first left return flange extending laterally from the first left clinch flange, opposite the second wall panel, to stiffen the first left clinch flange; and the second wall panel configured to install on the floor panel adjacent the first wall panel and comprising:

a second right column element configured to abut the first left column element of the first wall panel;

a second exterior surface cooperating with the first exterior surface of the first wall panel to form an exterior façade;

a second right channel section coupled to the second right column element and cooperating with the first left channel section to define an exterior mounting receptacle:

facing outwardly from the second wall panel;

extending vertically between the first wall panel and the second wall panel; and retaining an exterior mount, the exterior mount locating an exterior attachment over the exterior façade;

a second right clinch flange:

extending rearward from the second right column element opposite the second exterior surface; and configured to mate to the first left clinch flange, via a series of clinch connections, to assemble the second wall panel to the first wall panel and locate the second right channel section adjacent the first left channel section to form the exterior mounting receptacle; and a second right return flange extending laterally from the second right clinch flange, opposite the first wall panel, to stiffen the second right clinch flange.

20. A building system comprising:

a first wall panel cooperating with a second wall panel, installed on a floor panel adjacent the first wall panel, to form an exterior façade, the first wall panel comprising:

a left column element configured to carry vertical loads through a left side of the first wall panel and abut a right column element of the second wall panel; and a left channel section coupled to the left column element and cooperating with a right channel section of the second wall panel to define an exterior mounting receptacle:

facing outwardly from the first wall panel;

extending vertically between the first wall panel and the second wall panel;

recessed behind the exterior façade; and configured to transiently retain an exterior mount;

the exterior mount comprising:

a left retention element defining:

a left return configured to insert into and extend laterally within the exterior mounting receptacle; and a left bracket coupled to the left return and configured to extend outwardly from the exterior façade;

a right retention element defining:

a right return configured to insert into and extend laterally within the exterior mounting receptacle opposite the left return; and a right bracket coupled to the right return and configured to extend outwardly from the exterior façade; and a fastener configured to clamp the left retention element to the right retention element to constrain the left return and the right return within the exterior mounting receptacle; and an exterior attachment configured to transiently install on the exterior mount and extend from the exterior façade.

* * * * *